US012758891B2

(12) United States Patent
Lin

(10) Patent No.: US 12,758,891 B2
(45) Date of Patent: Oct. 13, 2026

(54) SWING ARM COMPONENT FOR TOY CAR

(71) Applicant: Qiayong Lin, Shantou (CN)

(72) Inventor: Qiayong Lin, Shantou (CN)

( * ) Notice: Subject to any disclaimer, the term of this patent is extended or adjusted under 35 U.S.C. 154(b) by 203 days.

(21) Appl. No.: 18/932,487

(22) Filed: Oct. 30, 2024

(65) Prior Publication Data

US 2026/0115612 A1 Apr. 30, 2026

(51) Int. Cl.

| | |
|---|---|
| ***A63H 31/00*** | (2006.01) |
| ***A63H 17/00*** | (2006.01) |
| ***A63H 17/28*** | (2006.01) |
| ***A63H 29/22*** | (2006.01) |

(52) U.S. Cl.

CPC ..... *A63H 31/00* (2013.01); *A63H 17/004* (2013.01); *A63H 17/28* (2013.01); *A63H 29/22* (2013.01)

(58) Field of Classification Search

CPC ..... A63H 17/00; A63H 17/26; A63H 29/00; A63H 29/22; A63H 29/24; A63H 31/00

See application file for complete search history.

(56) References Cited

U.S. PATENT DOCUMENTS 3,243,917 A * 4/1966 Giammarino ..... B60L 15/20 446/446
3,964,206 A * 6/1976 Bernhard ..... A63H 18/12 446/455
4,031,661 A * 6/1977 Bernhard ..... A63H 18/12 446/130
4,283,879 A * 8/1981 Tsui ..... A63H 17/00 446/463
5,006,090 A * 4/1991 Kennedy ..... A63H 18/12 446/457
5,100,368 A * 3/1992 Chien ..... A63H 31/00 446/463
6,805,609 B1 * 10/2004 Paukert ..... A63H 17/00 446/457
7,255,618 B2 * 8/2007 Leonov ..... A63H 17/262 440/98
8,337,274 B1 * 12/2012 Wong ..... A63H 18/12 446/457
2026/0048333 A1 * 2/2026 Dobrogorsky ..... A63H 1/00

* cited by examiner

*Primary Examiner* — Kurt Fernstrom
(74) *Attorney, Agent, or Firm* — Birchwood IP

(57) ABSTRACT

A swing arm assembly for a toy car is provided, which includes a housing, a gear train, a light strip, a circular brush disc, and two brush blades. The housing includes a cavity and a communication port that communicates with the cavity. Each gear is rotatably provided on the housing. The light strip is connected to the housing. The circular brush disc includes a first slip ring and a second slip ring, and the first slip ring is located on an outside of the second slip ring. The two brush blades are both provided on the housing, one brush blade is attached to the first slip ring and the other one is attached to the second slip ring. During a rotation of the housing relative to the circular brush disc, the two brush blades are respectively kept in contact with corresponding first slip ring and the second slip ring.

10 Claims, 8 Drawing Sheets

SWING ARM COMPONENT FOR TOY CAR

TECHNICAL FIELD

The present disclosure relates to the field of toy cars technologies, and in particular, to a swing arm component for a toy car.

BACKGROUND

The existing flipping stunt cars usually include a car body and swing frames set on two sides of the car body. The swing frames are connected to a wheel, and middles of the swing frames are rotatably connected to the car body. The swing frames can rotate relative to the car body, allowing the flipping stunt cars to perform flipping stunt effects, which are deeply loved by children. However, some flip stunt cars in the existing technology do not have light installed on the swing frame, which renders poor visual effects during playing the flip stunt cars and not cool enough, especially for children who cannot see the flipping of the car clearly at night, resulting in a poor playing experience for children. Or the light is only installed on the car body, only the car body can be seen clearly, but the flipping action made by the swing frames cannot be seen clearly at night, resulting in a poor gaming experience for children.

At present, some flip stunt cars have installed lights on their swing frames, but the light requires batteries inside the cars to provide power. In existing technology, a cable is connected between the battery on the car body and the swing frame, and the middle of the swing frame has a connection hole. One end of the cable is electrically connected to the battery on the car body, and the other end is electrically connected to the light on the swing frame through the connection hole, so that the light is powered on. However, such a cable setting will cause the cable to twist and entangle when the swing frame is rotated, affecting the performance of the flip stunt car and rendering it impossible for the flip stunt car to flip 360 degrees wirelessly, resulting in a poor gaming experience for children.

In view of this, the present application is proposed.

SUMMARY

To solve one of the above problems, the present application provides a swing arm assembly for a toy car.

The present application provides the following technical solution.

A swing arm assembly for a toy car, including:

a housing, which includes a cavity and a communication port that communicates with the cavity;

a gear train, which is located within the cavity and includes a plurality of gears, each of the plurality of gears is rotatably provided on the housing, and some of the plurality of gears are connected with a wheel;

a light strip, which is connected to the housing;

a circular brush disc, which is located inside the cavity and at the communication port; the circular brush disc is configured to be fixed to a car body and includes a first slip ring and a second slip ring; where the first slip ring is located an outside of the second slip ring;

two brush blades, both of which are provided on the housing, one brush blade is attached to the first slip ring and the other brush blade is attached to the second slip ring; one ends of the two brush blades are connected to the light strip;

during a rotation of the housing relative to the circular brush disc, the two brush blades are respectively kept in contact with the first slip ring and the second slip ring.

In some embodiment of the present application, one side of the circular brush disc away from the communication port is provided with the first slip ring and the second slip ring.

In some embodiment of the present application, the circular brush disc is provided with a first wiring ring and a second wiring ring, the first wiring ring and the second wiring ring are both located on one surface of the circular brush disc where the first slip ring and the second slip ring are provided, and both the first wiring ring and the second wiring ring are located on an inner side of the second slip ring;

the first wiring ring is electrically connected to the first slip ring, and the second wiring ring is electrically connected to the second slip ring.

In some embodiment of the present application, the swing arm assembly for the toy car further includes a wiring copper sheet;

the second slip ring and the second wiring ring are integrally formed;

the wiring copper sheet is located on one side of the circular brush disc facing away from the first slip ring;

one end of the wiring copper sheet is electrically connected to the first slip ring, and the other end of the wiring copper sheet is electrically connected to the first wiring ring.

In some embodiment of the present application, the wiring copper sheet is extended along a radius direction of the circular brush disc;

one end of the wiring copper sheet close to an edge of the circular brush disc is connected to the first slip ring through a conductor passing through a thickness direction of the circular brush disc;

one end of the wiring copper sheet close to a center of the circular brush disc is connected to the first wiring ring through the conductor passing through the thickness direction of the circular brush disc.

In some embodiment of the present application, the housing includes a convex shaft and a clamp plate;

the brush blade includes a fixed piece and an extension piece connected to the fixed piece;

the fixed piece has a limit hole, and the extension piece is connected to the fixed piece, thereby forming a clamp gap between the extension piece and the fixed piece;

the limit hole is sleeved on the convex shaft, and the clamp plate is extended to the clamp gap of the fixed piece;

a free end of the extension piece is extended to the corresponding first slip ring or the second slip ring.

In some embodiment of the present application, the circular brush disc and one gear in the gear train are coaxially arranged, and the gear is connected to a drive shaft on the car body.

In some embodiment of the present application, an annular groove is formed on a peripheral edge of the housing; and the light strip is embedded in the annular groove.

In some embodiment of the present application, the swing arm assembly for the toy car further includes a lampshade, where the lampshade is embedded in the annular groove and covers the light strip.

In some embodiment of the present application, the housing includes a first housing and a second housing;

the first housing and the second housing are interlocked, and the annular groove is formed between the first housing and the second housing;

the first housing is provided with a caulking groove, and the second housing is provided with an insertion groove;

the lampshade includes a plug strip and a plug shaft, the plug strip is embedded in the caulking groove, and the plug shaft is inserted into the insertion groove.

By adopting the above technical solution, the present application has the following beneficial effects.

The swing arm assembly for a toy car in the present application is provided with a circular brush disc and two brush blades, allowing a swing frame to maintain electrical connection even when it is rotated freely, thereby avoiding a problem of cable winding and twisting when using a cable connection, ensuring a performance of the toy car and providing a good playing experience for children.

The specific embodiments of the present application will be further described in detail with reference to the accompanying drawings.

BRIEF DESCRIPTION OF DRAWINGS

The accompanying drawings, as a part of the present application, are used to provide further understanding of the present application. The illustrative embodiments and their explanations of the present application are used to explain the present application, but do not constitute undue limitation of the present application. Obviously, the drawings described below are only some embodiments. For those skilled in the art, other drawings can be obtained based on these drawings without creative work.

Figure 1:
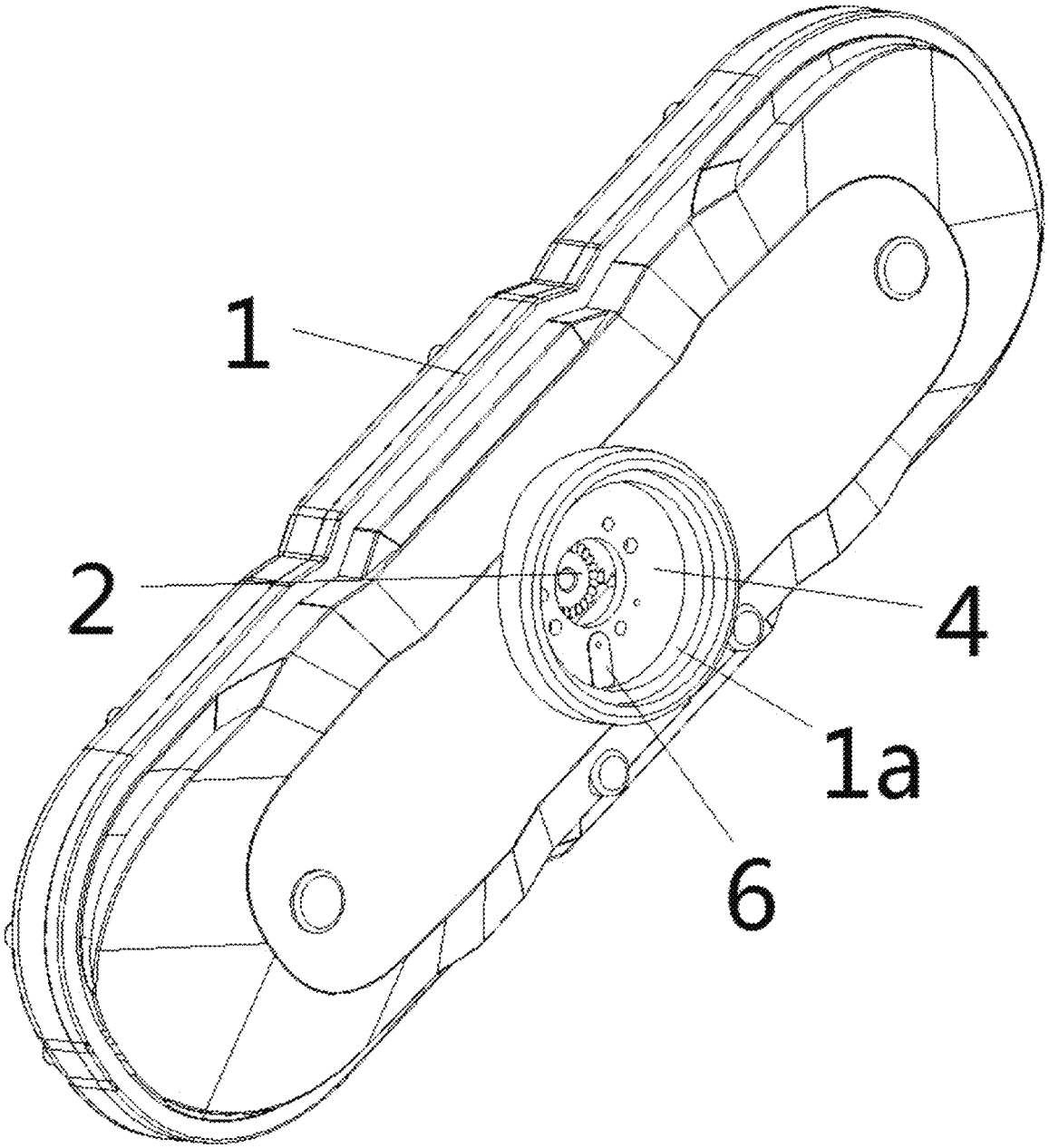
FIG. 1 is a schematic structural diagram of a swing arm assembly of a toy car provided in an embodiment of the present application.

NUMERAL REFERENCE housing 1, communication port 1*a*, convex shaft 1*b*, clamp plate 1*c*, annular groove 1*d*, first housing 11, caulking groove 111, second housing 12, insertion groove 121, gear train 2, gear 21, light strip 3, circular brush disc 4, first slip ring 41, second slip ring 42, first wiring ring 43, second wiring ring 44, connection hole 45, conductor 46, brush blade 5, fixed piece 51, limit hole 511, extension piece 52, protrusion 521, clamp gap 53, wiring copper sheet 6, lampshade 7, plug strip 71, and plug shaft 72.

It should be noted that these drawings and descriptions are not intended to limit the conceptual scope of the present application in any way, but rather to illustrate the concept of the present application for those skilled in the art by referring to specific embodiments.

DESCRIPTION OF EMBODIMENTS

In order to clarify the purpose, technical solution, and advantages of the embodiments of the present application, the technical solution in the embodiments will be described clearly and completely in combination with the accompanying drawings. The following embodiments are used to illustrate the present application, but not to limit the scope of the present application.

In the description of the present application, it should be noted that terms "up", "down", "inside", "outside", etc. indicate orientation or positional relationships based on the orientation or positional relationships shown in the accompanying drawings, only for a convenience of describing the present application and simplifying the description, and do not indicate or imply that the device or component referred to must have a specific orientation, be constructed and operated in a specific orientation, and therefore cannot be understood as limiting the present application.

In the description of the present application, it should be noted that unless otherwise specified and limited, terms "installation" and "connection" should be broadly understood, for example, they can be a fixed connection, a detachable connection, or an integral connection; it can be a mechanical connection or an electrical connection; it can be directly connected or indirectly connected through an intermediate medium. For those skilled in the art, the specific meanings of the above terms in the present application can be understood in a specific situation.

As shown in FIGS. 1 to 10, an embodiment of the present application provides a swing arm assembly for a toy car, which includes a housing 1, a gear train 2, a light strip 3, a circular brush disc 4, and two brush blades 5. The housing 1 includes a cavity and a communication port 1*a* that communicates with the cavity. The gear train 2 is located inside the cavity and includes a plurality of gears 21. Each of the plurality of gears 21 is rotatably provided on the housing 1. Some of the plurality of gears 21 are used to connect with a wheel. The light strip 3 is connected to the housing 1. The circular brush disc 4 is located inside the cavity, and is located at the communication port 1*a*. The circular brush disc 4 is used to be fixedly connected to a car body (not shown) and includes a first slip ring 41 and a second slip ring 42. The first slip ring 41 is located an outside of the second slip ring 42. The circular brush disc 4 is fixed to the car body by a fastener (not shown), and a connection hole 45 is provided on the circular brush disc 4. The car body has a threaded hole (not shown), and the fastener can be a screw. A rod of the screw passes through the connection hole 45 and is threaded to a threaded hole. A cap of the screw is limited to one side of the circular brush disc 4 facing away from the car body. The two brush blades 5 are both provided on the housing 1. One brush blade 5 is attached to the first slip ring 41, and the other one is attached to the second slip ring 42. One ends of the two brush blades 5 are connected to the light strip 3. During a rotation of the housing 1 relative to the circular brush disc 4, the two brush blades 5 are respectively kept in contact with the corresponding first slip ring 41 and the second slip ring 42. The swing arm assembly for the toy car in the present application is provided with the circular brush disc 4 and two brush blades 5, allowing a swing frame to maintain electrical connection even when it is rotated freely, thereby avoiding a problem of cable winding and twisting when using a cable connection, ensuring a performance of the toy car, and providing a good playing experience for children.

Figure 3:
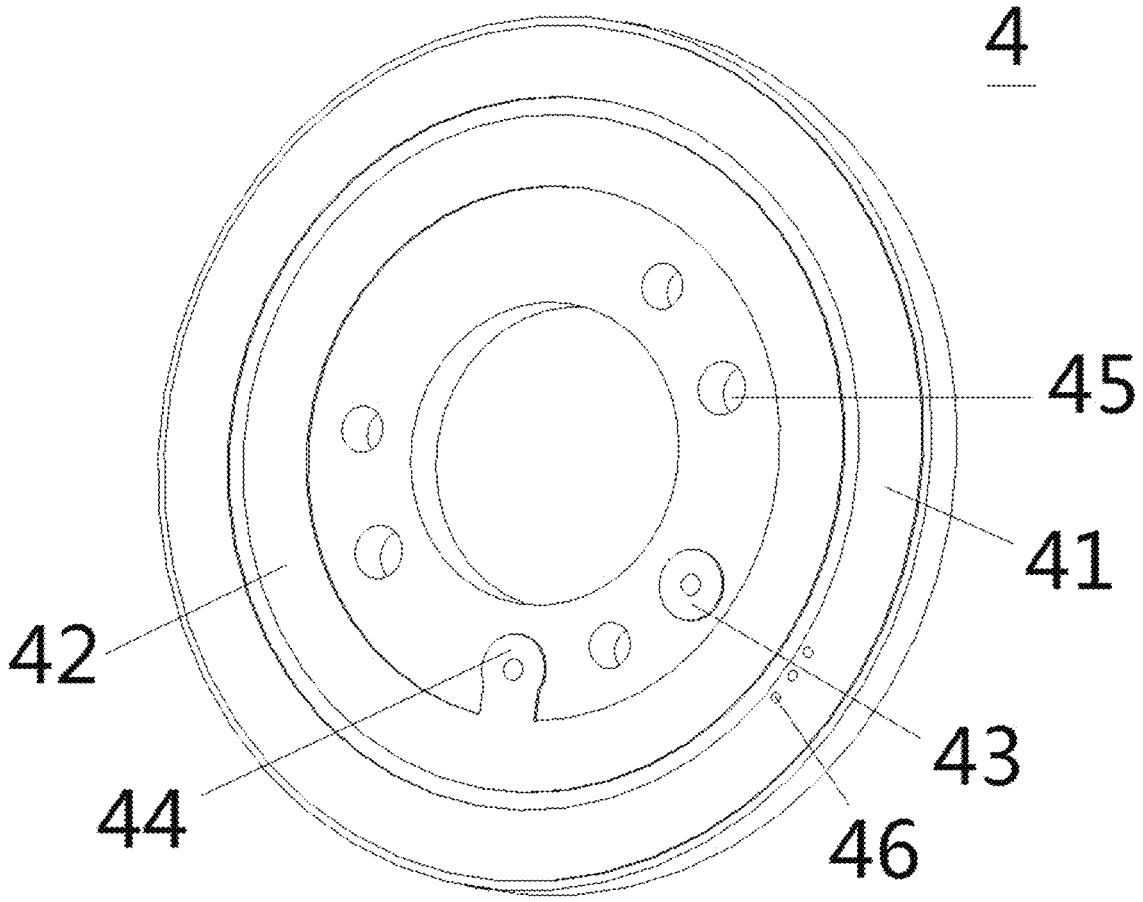
FIG. 3 is a schematic structural diagram of a circular brush disc of the swing arm assembly for the toy car provided in an embodiment of the present application.
Figure 4:
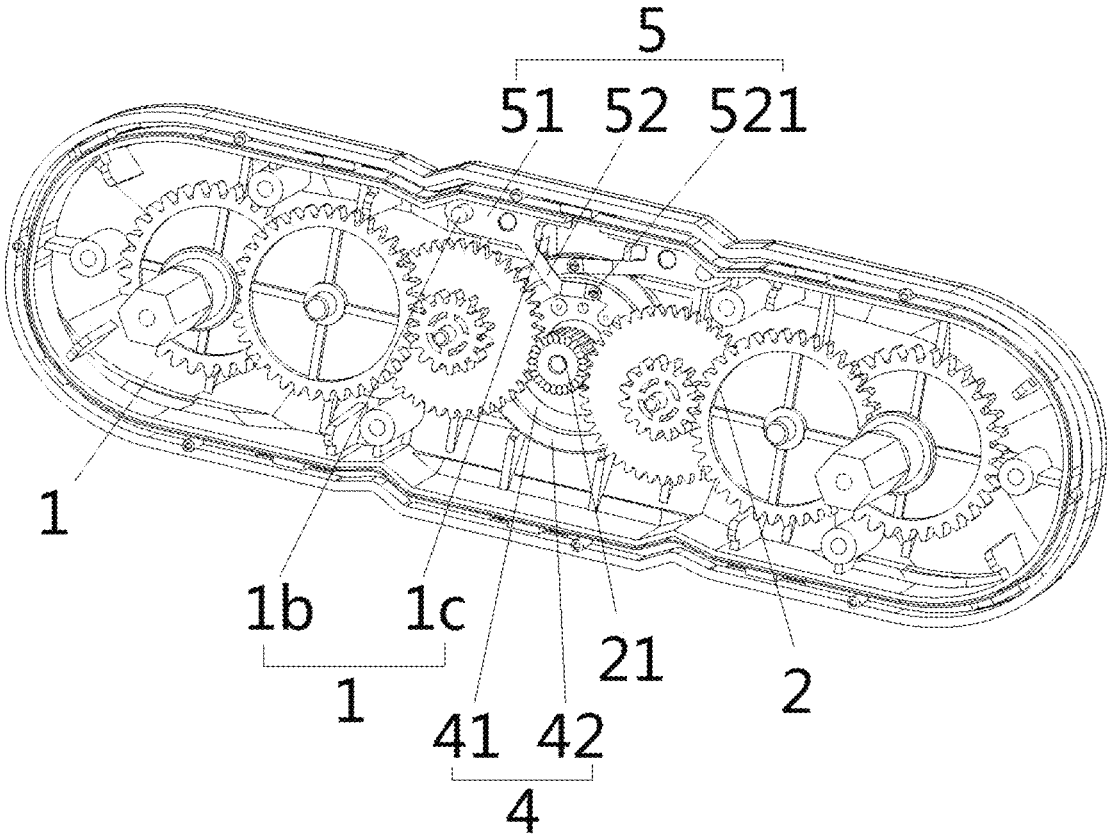
FIG. 4 is a schematic diagram of an internal structure of the swing arm assembly for the toy car provided in an embodiment of the present application, with a second housing removed.

As shown in FIGS. 3 and 4, the circular brush disc 4 is provided with the first slip ring 41 and the second slip ring 42 on one side facing away from the communication port 1*a*. The two brush blades 5 are also provided on one side of the circular brush disc 4 facing away from the communication port 1*a*. The first slip ring 41 and the second slip ring 42 are convenient for connecting with the two brush blades 5, and the first slip ring 41 and the second slip ring 42 will not interfere with a connection between the circular brush disc 4 and the car body.

As shown in FIGS. 3 and 4, the circular brush disc 4 is provided with a first wiring ring 43 and a second wiring ring 44. The first wiring ring 43 and the second wiring ring 44 are both located on one side of the circular brush disc 4 where the first slip ring 41 and the second slip ring 42 are located, and the first wiring ring 43 and the second wiring ring 44 are both located on an inner side of the second slip ring 42. The first wiring ring 43 and the second wiring ring 44 do not interfere with a connection between the two brush blades 5 with the first slip ring 41 and the second slip ring 42. The first wiring ring 43 is electrically connected to the first slip ring 41, and the second wiring ring 44 is electrically connected to the second slip ring 42. The first wiring ring 43 and the second wiring ring 44 cannot be provided on the first slip ring 41 or the second slip ring 42, which will affect an electrical connection between the brush blade 5 with the first slip ring 41 and the second slip ring 42. Ends of the two brush blades 5 are provided with a protrusion 521, one protrusion 521 is contacted to the first slip ring 41 and the other protrusion 521 is contacted to the second slip ring 42, thereby providing power to the brush blades 5.

Figure 2:
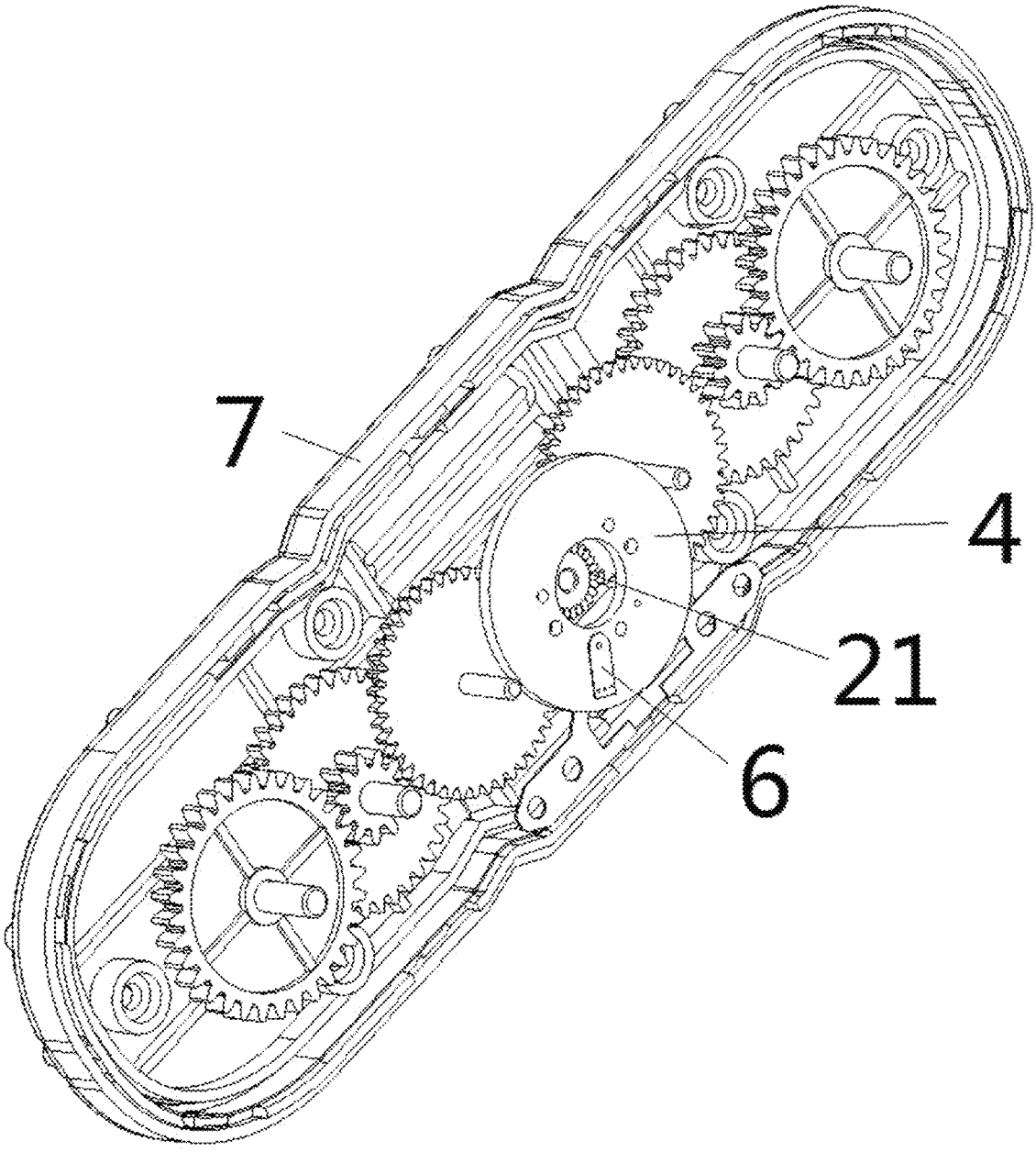
FIG. 2 is a schematic diagram of an internal structure of the swing arm assembly for the toy car provided in an embodiment of the present application, with a first housing removed.

In an implementation mode, as shown in FIGS. 1, 2, and 3, the swing arm assembly for the toy car includes a wiring copper sheet 6. The second slip ring 42 and the second wiring ring 44 are integrally formed, and an integrally formed structure is simple and easy to install. The wiring copper sheet 6 is located on one side of the circular brush disc 4 facing away from the first slip ring 41. One end of the wiring copper sheet 6 is electrically connected to the first slip ring 41, and the other end of the wiring copper sheet 6 is electrically connected to the first wiring ring 43. If the first slip ring 41 is directly connected to the first wiring ring 43 through the wiring copper sheet 6 passing through the second slip ring 42, it will cause a short circuit due to a direct electrical connection between the first slip ring 41 and the second slip ring 42. Therefore, the wiring copper sheet 6 needs to cross the second slip ring 42 and connect to the first wiring ring 43 so as to avoid causing a short circuit in the circuit.

As shown in FIGS. 1 to 3, the wiring copper sheet 6 is extended along a radius direction of the circular brush disc 4. One end of the wiring copper sheet 6 close to an edge of the circular brush disc 4 is connected to the first slip ring 41 through a conductor 46 passing through a thickness direction of the circular brush disc 4. One end of the wiring copper sheet 6 close to a center of the circular brush disc 4 is connected to the first wiring ring 43 through the connector passing through the thickness direction of the circular brush disc 4. The circular brush disc 4 is provided with three holes at one end close to an edge, which are extended along the thickness direction of the circular brush disc 4. Each hole is provided with the conductor 46, that is, three conductors 46 each passes through the three holes and are connected to one ends of the first slip ring 41 and the wiring copper sheet 6, and the other end of the wiring copper sheet 6 is close to the center of the circular brush disc. A through hole is provided in a middle of the circular brush disc 4, and an inner wall of the through hole is provided with the conductor, this conductor can be a cylindrical conductor. One end of the cylindrical conductor is connected to the wiring copper sheet 6, and the other end is connected to the first wiring ring 43.

The car body is provided with a battery (not shown) and a circuit board. The circuit board is connected to the battery, and two cables are led out from the circuit board. The two cables are respectively connected to the first wiring ring 43 or the second wiring ring 44. The circular brush disc 4 is provided with a through hole at a position corresponding to a position of the second wiring ring 44. The cable passes through the through hole and is connected to the second wiring ring 44. The cable can be connected to the second wiring ring 44 by welding. Another cable passes through the cylindrical conductor and is connected to the first wiring ring 43, and the cable can be welded to the first wiring ring 43.

Figure 10:
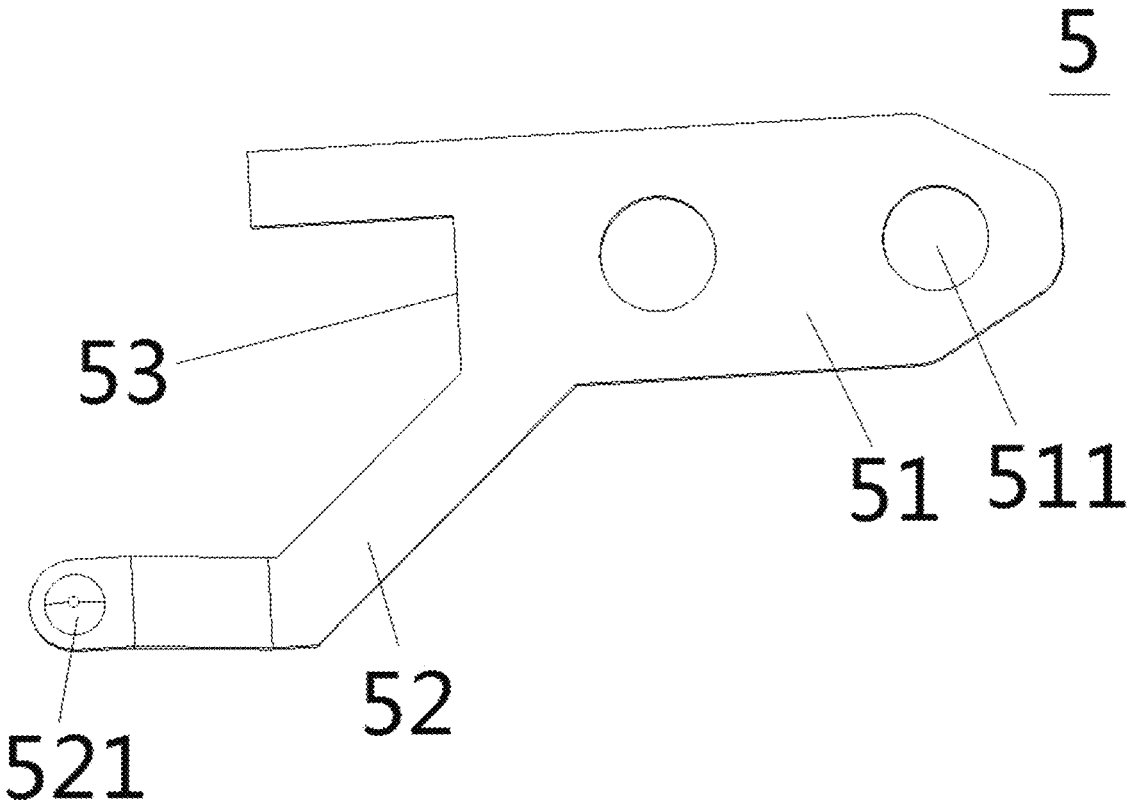
FIG. 10 is a schematic structural diagram of a brush blade of the swing arm assembly for the toy car provided in an embodiment of the present application.

In an implementation mode, as shown in FIGS. 4 and 10, the housing 1 includes a convex shaft 1*b* and a clamp plate 1*c*, and the brush blade 5 includes a fixed piece 51 and an extension piece 52 connecting the fixed piece 51. The fixed piece 51 includes a limit hole 511, and the extension piece 52 is connected to the fixed piece 51, thereby forming a clamp gap 53 between the extension piece 52 and the fixed piece 51. The limit hole 511 is sleeved on the convex shaft 1*b*, and the clamp plate 1*c* is extended to the clamp gap 53 of the fixed piece 51. A fixed method of clamp connection has a simple structure and is convenient for assembly. A free end of the extension piece 52 is extended to the corresponding first slip ring 41 or the second slip ring 42. The free end of the extension piece 52 includes the protrusion 521, which is in contact with the corresponding first slip ring 41 or the second slip ring 42.

The circular brush disc 4 and one gear 21 in the gear train 2 are arranged coaxially, and the gear 21 can be connected to a drive shaft (not shown) on the car body. A rotation axis of the gear 21 passes through the center of the circular brush disc 4. When the gear 21 drives the wheel to rotate and flip, which is not affected by the circular brush disc 4.

Figure 5:
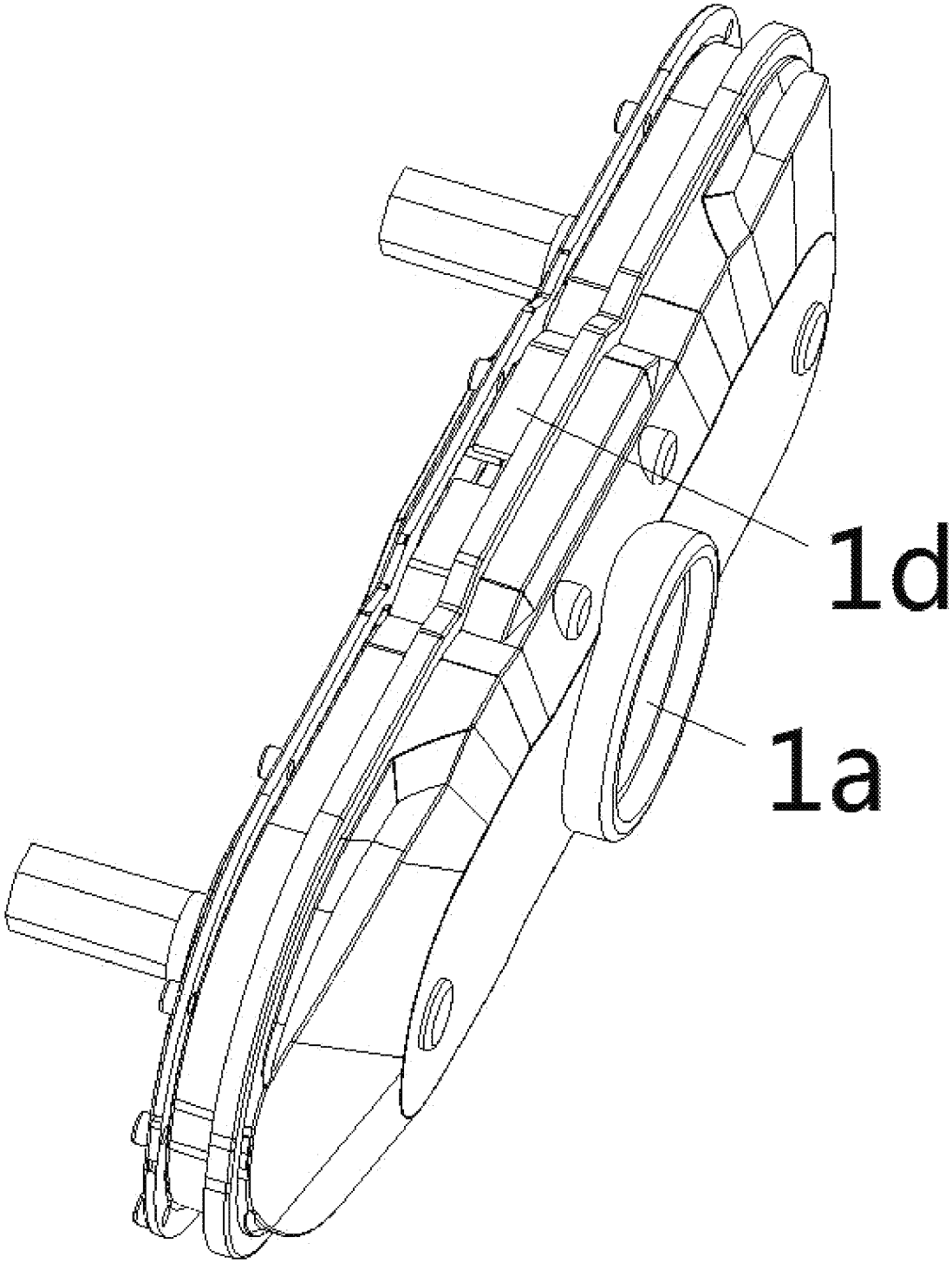
FIG. 5 is a schematic structural diagram of the swing arm assembly for the toy car provided in an embodiment of the present application, with a lampshade removed.
Figure 6:
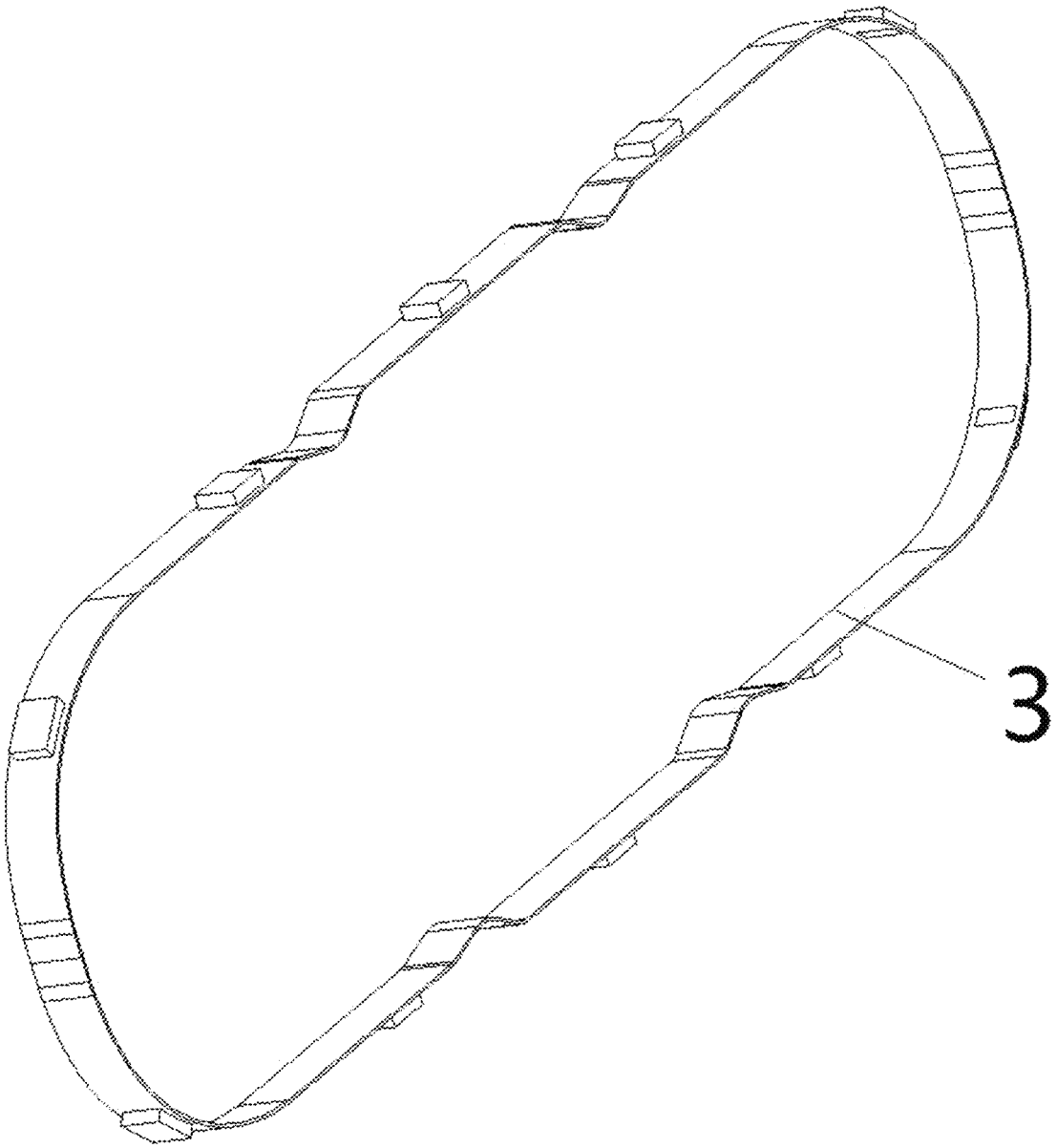
FIG. 6 is a schematic structural diagram of a light strip of the swing arm assembly for the toy car provided in an embodiment of the present application.

As shown in FIGS. 5 and 6, an annular groove 1*d* is formed along a periphery edge of the housing 1. The light strip 3 is embedded in the annular groove 1*d*. The annular groove 1*d* facilitates an installation of the light strip 3. The light strip 3 is located within the annular groove 1*d*, thereby ensuring that the light strip 3 does not protrude from an outer surface of the housing 1, rendering it less susceptible to collisions from an external object and less likely to be damaged.

Figure 7:
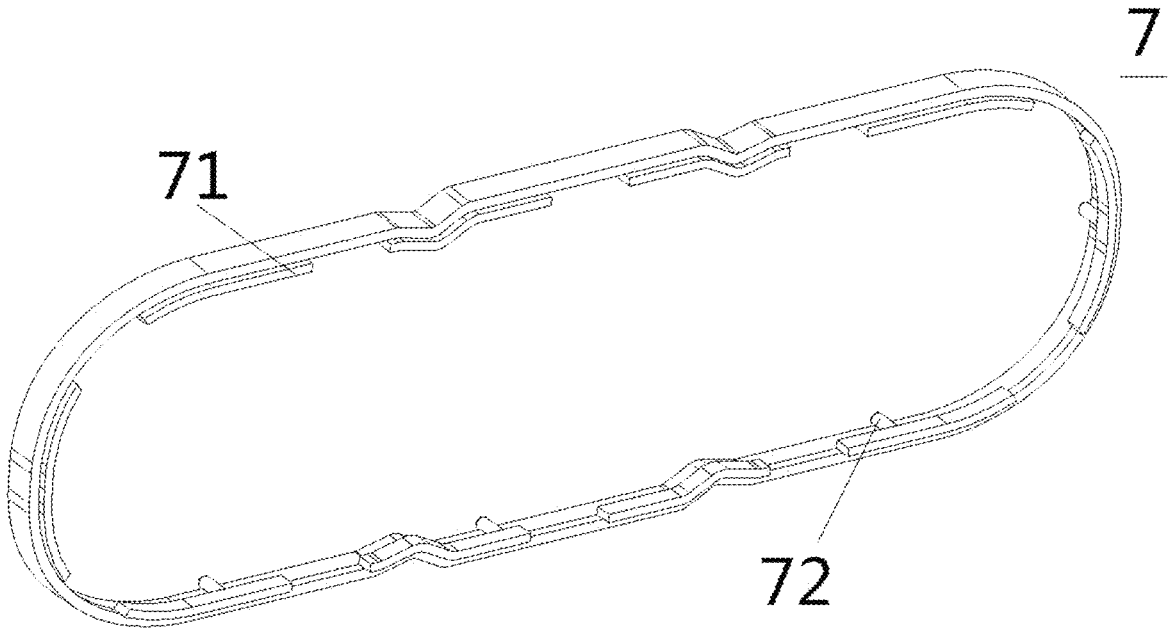
FIG. 7 is a schematic structural diagram of the lampshade of the swing arm assembly for the toy car provided in an embodiment of the present application.

In an implementation mode, as shown in FIGS. 2 and 7, the swing arm assembly for the toy car includes a lampshade 7, the lampshade 7 is embedded in the annular groove 1*d* and covers the light strip 3. The lampshade 7 can protect the light strip 3 from falling out and being damaged by the external object. The lampshade 7 can be transparent, allowing light emitted by the light strip 3 to be transmitted.

Figure 8:
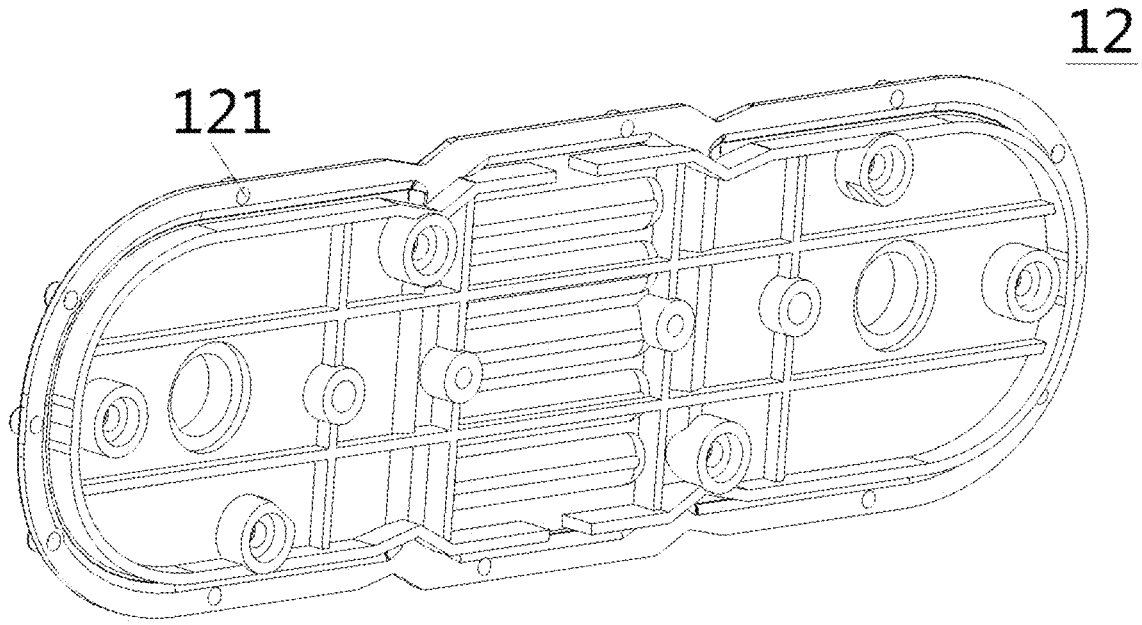
FIG. 8 is a schematic structural diagram of the second housing of the swing arm assembly for the toy car provided in an embodiment of the present application.
Figure 9:
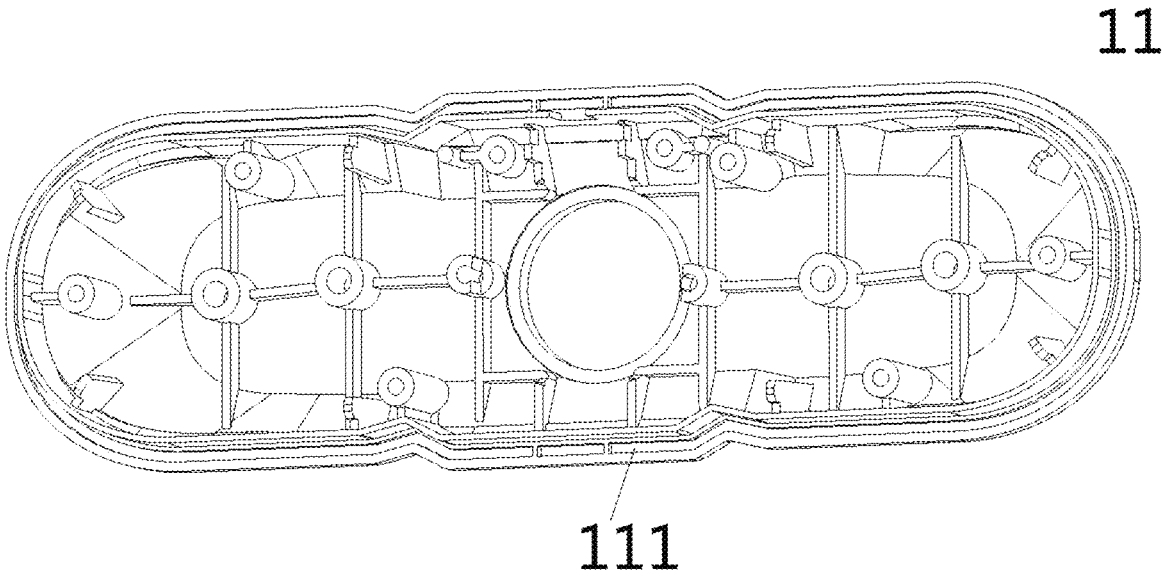
FIG. 9 is a schematic structural diagram of the first housing of the swing arm assembly for the toy car provided in an embodiment of the present application.

As shown in FIGS. 8 and 9, the housing 1 includes a first housing 11 and a second housing 12. The first housing 11 and the second housing 12 are interlocked, and the annular groove 1*d* is formed between the first housing 11 and the second housing 12. The first housing 11 is provided with a caulking groove 111, and the second housing 12 is provided with an insertion groove 121. The lampshade 7 includes a plug strip 71 and a plug shaft 72. The plug strip 71 is embedded into the caulking groove 111, and the plug shaft 72 is inserted into the insertion groove 121. A plug-in connection way facilitates an installation of the light strip 3 and the lampshade 7, thereby improving the assembly efficiency.

The above description is only preferred embodiments of the present application and does not limit the present application in any form. Although the present application has been disclosed in the preferred embodiments, it is not intended to limit the present application. Any skilled person familiar with the present patent may make slight changes or modifications to equivalent embodiments using the technical content provided above without departing from the scope of the present application. Any minor modifications, equivalent changes, and modifications made to the above embodiments based on the technical essence of the present application that do not depart from the scope of the present application are still within the scope of the present application.

What is claimed is:

1. A swing arm assembly for a toy car, comprising:

a housing, which comprises a cavity and a communication port that communicates with the cavity;

a gear train, which is located within the cavity and comprises a plurality of gears, each of the plurality of gears is rotatably provided on the housing, and some of the plurality of gears are connected with a wheel;

a light strip, which is connected to the housing;

a circular brush disc, which is located inside the cavity and at the communication port; the circular brush disc is configured to be fixed to a car body and comprises a first slip ring and a second slip ring; wherein the first slip ring is located an outside of the second slip ring;

two brush blades, both of which are provided on the housing, one brush blade is attached to the first slip ring and the other brush blade is attached to the second slip ring; one ends of the two brush blades are connected to the light strip;

during a rotation of the housing relative to the circular brush disc, the two brush blades are respectively kept in contact with the first slip ring and the second slip ring.

2. The swing arm assembly for the toy car according to claim 1, wherein one side of the circular brush disc away from the communication port is provided with the first slip ring and the second slip ring.

3. The swing arm assembly for the toy car according to claim 2, wherein the circular brush disc is provided with a first wiring ring and a second wiring ring, the first wiring ring and the second wiring ring are both located on one surface of the circular brush disc where the first slip ring and the second slip ring are provided, and both the first wiring ring and the second wiring ring are located on an inner side of the second slip ring;

the first wiring ring is electrically connected to the first slip ring, and the second wiring ring is electrically connected to the second slip ring.

4. The swing arm assembly for the toy car according to claim 3, further comprising a wiring copper sheet;

the second slip ring and the second wiring ring are integrally formed;

the wiring copper sheet is located on one side of the circular brush disc facing away from the first slip ring;

one end of the wiring copper sheet is electrically connected to the first slip ring, and the other end of the wiring copper sheet is electrically connected to the first wiring ring.

5. The swing arm assembly for the toy car according to claim 4, wherein the wiring copper sheet is extended along a radius direction of the circular brush disc;

one end of the wiring copper sheet close to an edge of the circular brush disc is connected to the first slip ring through a conductor passing through a thickness direction of the circular brush disc;

one end of the wiring copper sheet close to a center of the circular brush disc is connected to the first wiring ring through the conductor passing through the thickness direction of the circular brush disc.

6. The swing arm assembly for the toy car according to claim 5, wherein the housing comprises a convex shaft and a clamp plate;

the brush blade comprises a fixed piece and an extension piece connected to the fixed piece;

the fixed piece has a limit hole, and the extension piece is connected to the fixed piece, thereby forming a clamp gap between the extension piece and the fixed piece;

the limit hole is sleeved on the convex shaft, and the clamp plate is extended to the clamp gap of the fixed piece;

a free end of the extension piece is extended to the corresponding first slip ring or the second slip ring.

7. The swing arm assembly for the toy car according to claim 1, wherein the circular brush disc and one gear in the gear train are coaxially arranged, and the gear is connected to a drive shaft on the car body.

8. The swing arm assembly for the toy car according to claim 1, wherein an annular groove is formed on a peripheral edge of the housing; and the light strip is embedded in the annular groove.

9. The swing arm assembly for the toy car according to claim 8, further comprising a lampshade, wherein the lampshade is embedded in the annular groove and covers the light strip.

10. The swing arm assembly for the toy car according to claim 9, wherein the housing comprises a first housing and a second housing;

the first housing and the second housing are interlocked, and the annular groove is formed between the first housing and the second housing;

the first housing is provided with a caulking groove, and the second housing is provided with an insertion groove;

the lampshade comprises a plug strip and a plug shaft, the plug strip is embedded in the caulking groove, and the plug shaft is inserted into the insertion groove.

* * * * *